US009544674B2

(12) United States Patent
Murata

(10) Patent No.: US 9,544,674 B2
(45) Date of Patent: Jan. 10, 2017

(54) MICROPHONE HOLDER

(71) Applicant: KABUSHIKI KAISHA AUDIO-TECHNICA, Machida-shi, Tokyo (JP)

(72) Inventor: Takashi Murata, Machida (JP)

(73) Assignee: KABUSHIKI KAISHA AUDIO-TECHNICA, Machida-shi, Tokyo (JP)

( * ) Notice: Subject to any disclaimer, the term of this patent is extended or adjusted under 35 U.S.C. 154(b) by 48 days.

(21) Appl. No.: 14/807,451

(22) Filed: Jul. 23, 2015

(65) Prior Publication Data

US 2016/0037246 A1 Feb. 4, 2016

(30) Foreign Application Priority Data

Jul. 29, 2014 (JP) ..... 2014-153739

(51) Int. Cl.

| | |
|---|---|
| ***G10H 1/00*** | (2006.01) |
| ***H04R 1/08*** | (2006.01) |
| ***G10D 13/00*** | (2006.01) |
| *H04R 17/02* | (2006.01) |
| *H04R 3/00* | (2006.01) |
| *H04R 1/02* | (2006.01) |

(52) U.S. Cl.

CPC ..... *H04R 1/08* (2013.01); *G10D 13/00* (2013.01)

(58) Field of Classification Search

CPC ..... H04R 1/08; H04R 1/46; H04R 2201/025; H04R 1/02; H04R 2410/00; G10H 3/146; G10H 2230/275; G10H 2230/371; G10H 3/12; G10H 3/181; G10D 13/02; G10D 13/00; G10G 5/00

USPC ..... 381/361, 118, 366, 91, 122; 84/421, 84/411 R, 723, 453, 104, 327, 730; 984/365, 984/151, 257; 248/124.2, 228.5, 248/229.11, 229.14, 229.24

See application file for complete search history.

(56) References Cited

U.S. PATENT DOCUMENTS

| | | | | |
|---|---|---|---|---|
| 4,899,633 | A * | 2/1990 | Lombardi | G10H 3/146 84/730 |
| 4,939,972 | A * | 7/1990 | Falberg | G10D 13/02 24/514 |
| 5,353,674 | A * | 10/1994 | Volpp | G10D 13/02 84/411 R |
| 2003/0001054 | A1* | 1/2003 | Sargent | F16M 13/02 248/176.1 |

(Continued)

FOREIGN PATENT DOCUMENTS

JP 2009-94851 A 4/2009

*Primary Examiner* — Paul S Kim
*Assistant Examiner* — Norman Yu
(74) *Attorney, Agent, or Firm* — Manabu Kanesaka

(57) ABSTRACT

A microphone holder includes: a holding member holding a microphone; and a mounting member fixed to a tension bolt for fixing a rim of a drum. The mounting member includes a first clamping portion having a first locking portion locking to a lower surface of the rim, a second clamping portion having a second locking portion locking the tension bolt, and a biasing member biasing in a direction allowing the first clamping portion and the second clamping portion to approach, wherein the mounting member is attached to the tension bolt by clamping the rim and the tension bolt between the first clamping portion and the second clamping portion, in a state that the first locking portion of the first clamping portion is locked to the lower surface of the rim and the second locking portion of the second clamping portion is locked to the head of the tension bolt.

10 Claims, 7 Drawing Sheets

(56) References Cited

U.S. PATENT DOCUMENTS

| | | | | |
|---|---|---|---|---|
| 2005/0263656 | A1* | 12/2005 | Chen | F16M 13/02<br>248/229.14 |
| 2012/0049025 | A1* | 3/2012 | Halverson | H04R 1/08<br>248/229.22 |

* cited by examiner

MICROPHONE HOLDER

RELATED APPLICATIONS

The present application is based on, and claims priority from, Japanese Application No. JP2014-153739 filed Jul. 29, 2014, the disclosure of which is hereby incorporated by reference herein in its entirety.

BACKGROUND OF THE INVENTION

Field of the Invention

The present invention relates to a microphone holder, particularly to a microphone holder for a drum, a tom-tom or a snare drum, for example, on the rim of which a microphone is attached for collecting sound of a drum kit.

Description of the Related Art

When sound of a drum kit is collected in a recording studio or a live hall, for example, microphones are arranged to collect sound of each drum or other instrument. In this situation, a microphone is placed very close to the drum head, or the percussion surface, of the drum.

One of the methods of setting a microphone is use of a microphone stand. However, space for the microphone stand is limited because cables, amplifiers or lighting equipment are crowdedly placed around the drum kit. Therefore, conventionally a microphone is often held by a microphone holder provided on the rim of the drum. The rim made of metal having a ring shape is fitted over the edge of the drum.

A conventional microphone holder 40, as shown in FIGS. 8 and 9, often has a clip like structure having a microphone holding portion 41 or 42 which holds a microphone, and the holder pinches the rim 22 placed on the periphery of a tom-tom 20 from both upper and lower sides with biasing force of a spring provided in the holder. With the clip like structure of the holding portion 41 or 42, however, the holder easily comes off due to lowering of the gripping force caused by long-term degradation of the spring. For example, the holder comes off due to misalignment of the holding portion caused by vibration of the drum during its performance. Japanese Unexamined Patent Application No. 2009-94851 discloses a microphone holder including a base portion having a hook arm and a hook portion for clamping a rim from upper and lower sides. The hook portion that is at a lower portion and is freely slidable, is additionally fixed with a screw.

The rim holds and presses the periphery of the drumhead against the opening edge of a shell of the drum. By changing the pressing force to the rim, the tension of the drum head changes and tuning is achieved accordingly.

More specifically, the rim is screw-fixed against the shell with tension bolts configured at the plurality of positions on the circumference. As the bolts are tightened more strongly, the pressing force against the rim increases and the tension of the drum head becomes higher. Thus the rim is temporarily fixed in the state that it can be pressed further.

However, when a microphone holder is attached with a clip or a hook to the rim, the total weight of the microphone and the microphone holder is locally applied to the rim, i.e. the microphone and the microphone holder are hanging from the fixing point on the rim. Consequently a problem arises that tuning may be adversely affected by the local displacement of the rim in the loading direction.

SUMMARY OF THE INVENTION

The present invention has been made to solve the above problems, and an object thereof is to provide a microphone holder for holding a microphone to a drum, without having any effects on the tensioned state of a rim and adversely affecting tuning and sound collection.

The microphone holder according to the present invention includes a holding member holding a microphone and a mounting member coupled to the holding member and adapted to be fixed to a tension bolt for fixing a rim of a drum, wherein the mounting member includes a first clamping portion having a first locking portion for locking to a lower surface of the rim, and a second clamping portion disposed above the first clamping portion and having a second locking portion for locking to a head of the tension bolt, and biasing member biasing in a direction allowing the first clamping portion and the second clamping portion to approach, and wherein the mounting member is attached to the tension bolt by clamping the rim and the head of the tension bolt between the first clamping portion and the second clamping portion with a biasing force of the biasing member, in a state that the first locking portion of the first clamping portion is locked to the lower surface of the rim and the second locking portion of the second clamping portion is locked to the head of the tension bolt.

The first locking portion of the first clamping portion includes an abutting surface having a non-slip surface, and a locking notch cut from one of the lateral sides and the abutting surface is desirably in contact with the lower surface of the rim in a state where the locking notch retains a body of the tension bolt.

In addition, the second locking portion of the second clamping portion includes a locking recess that is recessed upwardly from an opening provided at a lower end of the second clamping portion, and the head of the tension bolt is desirably configured to be inserted into the locking recess.

Further in addition, the biasing member includes a first support supporting the first clamping portion on one end and a first lever on the other end, a second support supporting the second clamping portion disposed above the first clamping portion on one end and a second lever disposed below the first lever on the other end, and a spring member provided between the first lever and the second lever and configured to bias in a direction separating the first lever and the second lever from each other. It is desirable that the first clamping portion and the second clamping portion are moved in a separating direction from each other by compressing the spring member and allowing the first lever and the second lever to come close to each other, and the first clamping portion and the second clamping portion are moved in a direction coming close to each other by stretching the spring member and allowing the first lever and the second lever to separate from each other.

Further in addition, preferably, the first and second supports are slidably engaged with each other.

Further in addition, the mounting member preferably has a pair of support legs extending toward the rim from both left and right sides of the mounting member, and distal ends of the pair of support legs are in contact with the rim.

The microphone holder thus-configured is fixed to the tension bolt, with which the tension of the drum head is adjusted, by the first and second clamping portions.

That is, since weight of the microphone is not loaded on the rim, the drum can be turned and sound collection is performed without adversely affect the tension of the dram head.

According to the present invention, weight of the microphone holder for mounting a microphone onto the drum and weight including the microphone do not adversely affect the tension of the dram head. Consequently, the drum can properly be turned and sound collection is successfully performed.

DESCRIPTION OF THE PREFERRED EMBODIMENTS

Figure 1:
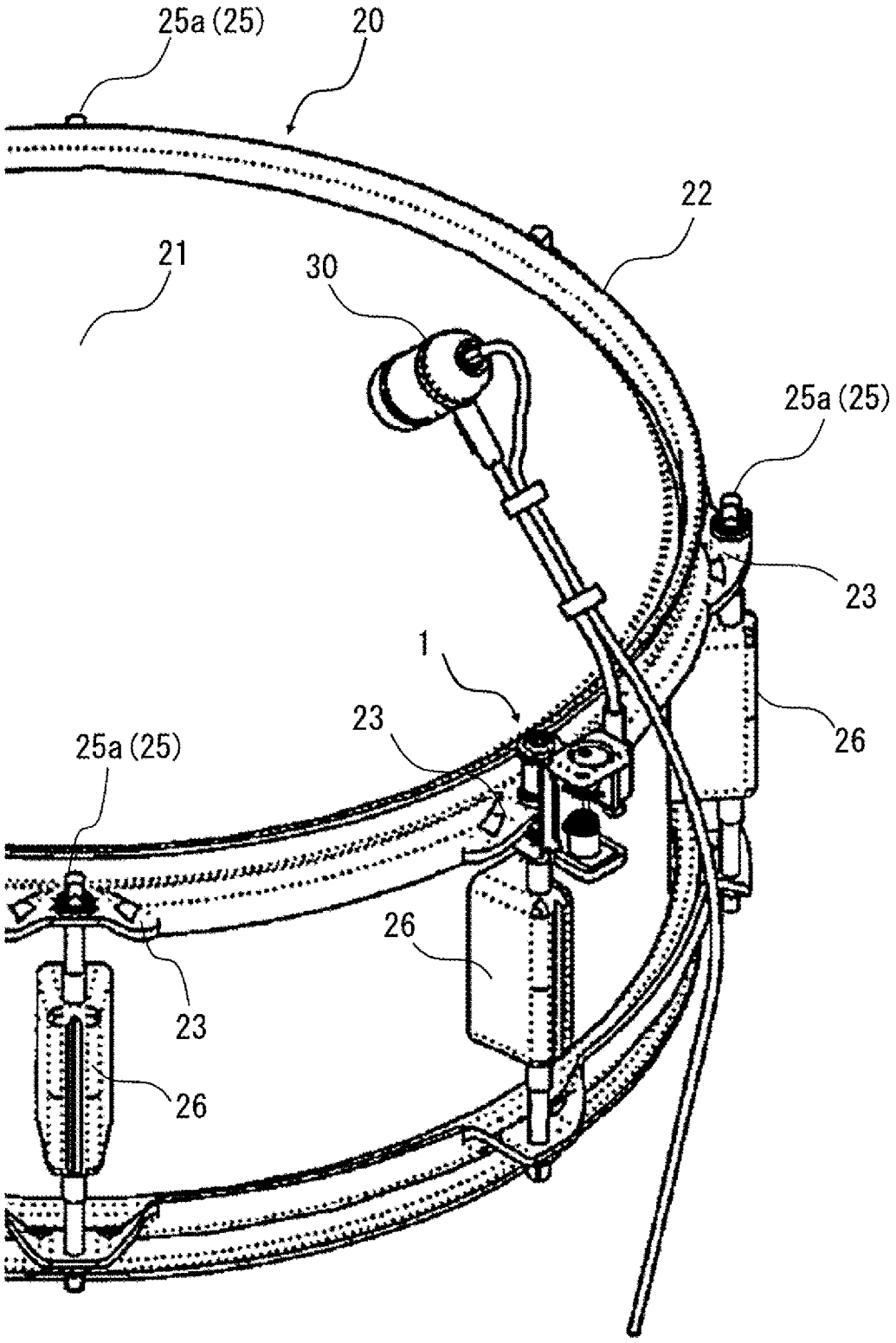
FIG. 1 is a perspective view of an arrangement of a microphone attached to a tom-tom using a microphone holder according to the present invention.
Figure 2:
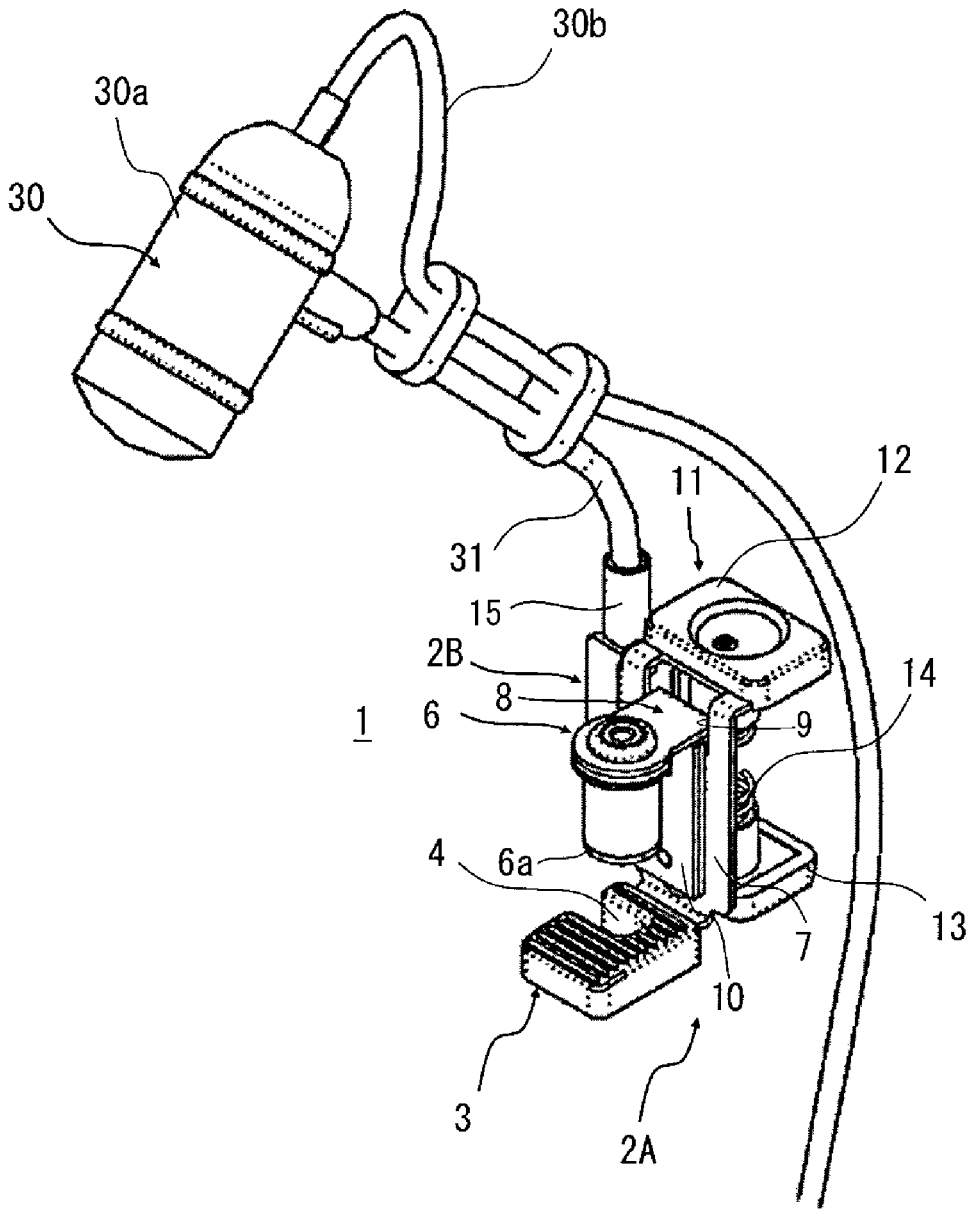
FIG. 2 is a perspective view of the microphone holder according to the present invention.
Figure 3:
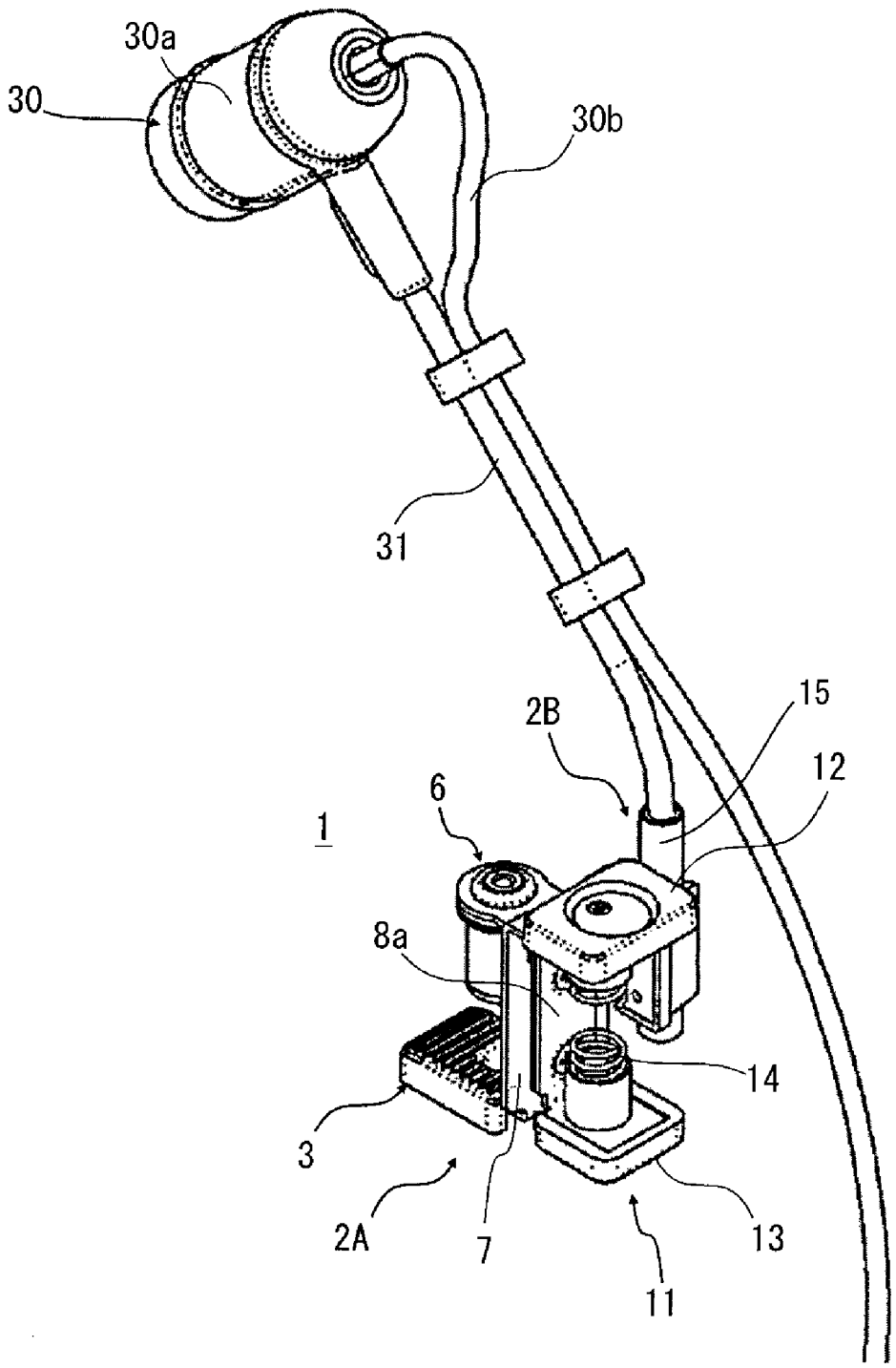
FIG. 3 is a perspective view of the microphone holder at a different angle from FIG. 2.
Figure 4:
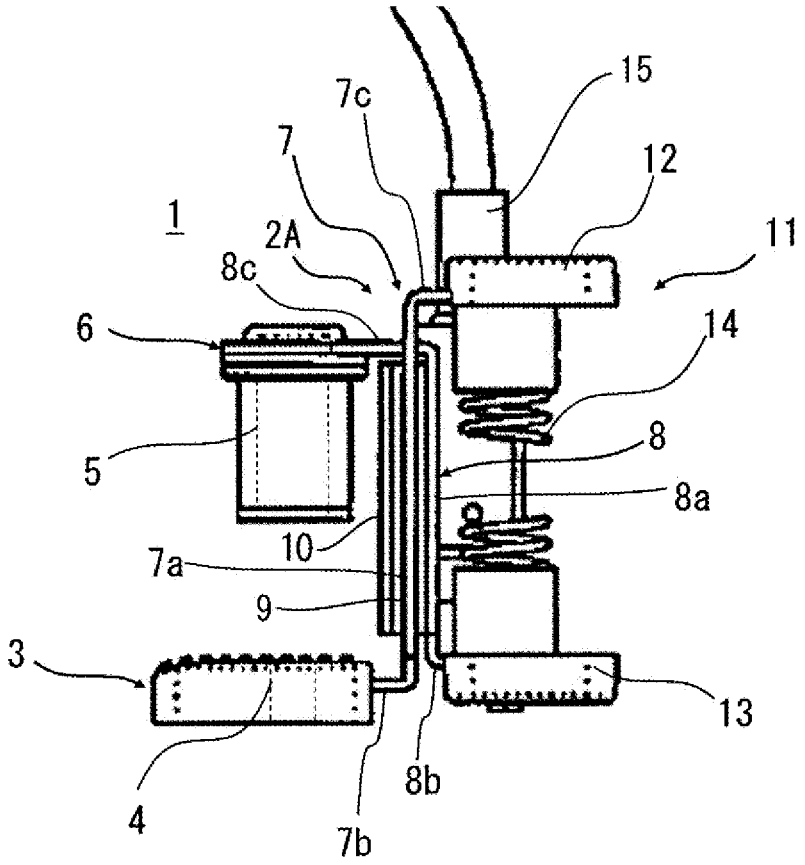
FIG. 4 is a side view of the microphone holder.
Figure 5:
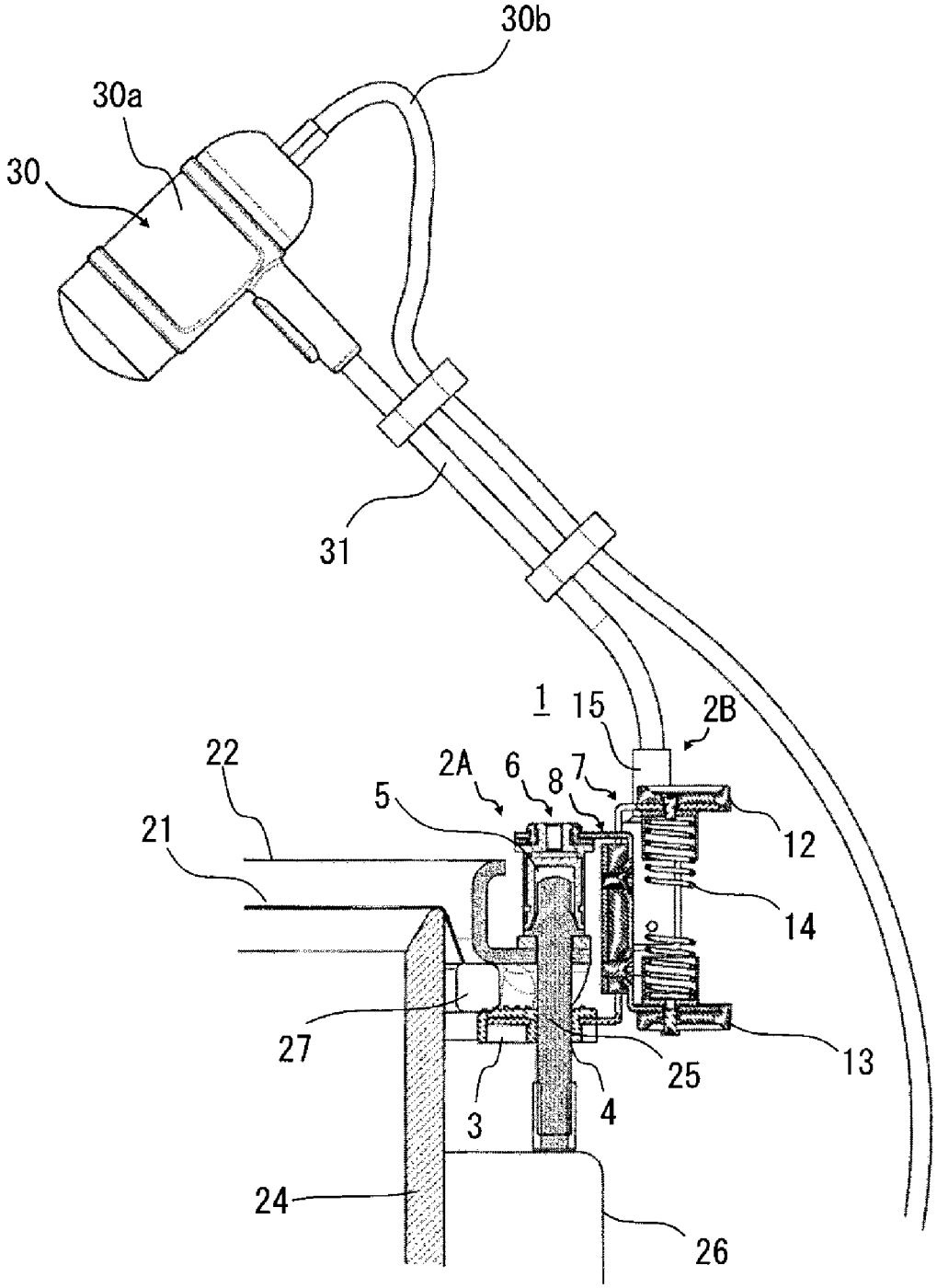
FIG. 5 is a cross-sectional view of the microphone holder attached on a tom-tom.

Hereinafter, embodiments of the invention will be described with reference to the accompanying drawings FIGS. 1 through 5. FIG. 1 is a perspective view of an arrangement of a microphone attached to a tom-tom using a microphone holder according to the present invention; FIG. 2 is a perspective view of the microphone holder according to the present invention; FIG. 3 is a perspective view of the microphone holder at a different angle from FIG. 2; FIG. 4 is a side view of the microphone holder; and FIG. 5 is a cross-sectional view of the microphone attached on a tom-tom according to the present invention. It is to be noted that all figures show the microphone holder that holds a microphone thereon.

In a tom-tom 20, as shown in FIG. 1, a metal ring-like rim 22 is provided over a periphery of a drum head 21, and the rim 22 is attached to a drum shell 24 at supports provided along the circumferential direction by tension bolts 25. More in detail, a plural of tension bolts 25 are screwed into a plural of lugs 26 provided on the drum shell 24, and the degree of tightening determines the pressing amount of the rim 22 against the shell 24. As shown in FIG. 5, a ring-like peripheral member 27 is provided on a periphery of the drum head 21 and the tension of the drum head is adjusted, that is, tuning of the tom-tom, by pressing the rim 22 onto the upper surface of the peripheral member 27.

A microphone holder 1 is coupled to one of the plurality of the tension bolts 25. A tension bolt is a stick-like member on a predetermined circumferential area of which is threaded and a bolt head 25*a* is provided on the opposite end of the threaded area. The tension bolt is set downward through a through-hole (not shown) provided on the supporting member 23 protruding outward along the radius direction on the periphery of the rim 22. The lower surface of the bolt head 25*a* is engaged with the periphery of the through-hole, rotatably around the axis of the tension bolt. Therefore, the bolt head 25*a* is configured to protrude upward from the supporting member 23.

In addition, a distal end of the tension bolt 25 is screwed into the lug 26 provided on the outer circumferential surface of the shell 24. By turning the bolt head 25*a* to screw the of the tension bolt 25 into the lug 26, the support member is pressed downward, and resultantly the rim 22 is pressed downward so as to have the drum head 21 tensioned higher.

As shown in FIGS. 2 and 3, the microphone holder 1 includes a mounting member 2A and a holding member 2B which holds a microphone 30.

The mounting member 2A has a first clamping portion 3, having a substrate of a rectangular in a plan view made of plastic, for instance. The upper face as an abutting surface of the first clamping portion is processed with an anti-slipping material such as roughened rubber-coating. The first clamping portion has a locking notch 4 (a first locking portion) with a U shape cut from one of the lateral sides to the center of the substrate, and the width of the locking notch 4 is formed as to be able to hold the body of the tension bolt 25.

The mounting member 2A has a second clamping portion 6 disposed above the first clamping portion 3. As shown in FIG. 4, by forming the second clamping portion into a cylinder shape, for instance, with the upper part of the cylinder being lidded and the lower part left open, the second clamping portion 6 includes a locking recess 5 (a second locking portion) recessed upwardly from an opening 6*a* provided at the lower end. The locking recess 5 is prepared to have such a width that the head 25*a* of tension bolt 25 can be inserted.

As shown in FIG. 4, the first clamping portion 3 and the second clamping portion 6 are supported by a first support 7 and a second support 8, respectively. The first support 7 and the second support 8 are slidably engaged with each other vertically. This sliding motion enables to change distance between the first clamping portion 3 (the locking notch 4) and the second clamping portion 6 (the locking recess 5).

Explaining in more detail, the first support 7 includes a raised portion 7*a* having a plate shape rising with a predetermined height, a flange 7*b* bent horizontally from the lower end of the raised portion 7*a*, and a flange 7*c* bent horizontally from the upper end of the raised portion 7*a* in the opposite direction to the flange 7*b*.

The first clamping portion 3 having the locking notch 4 is supported by the flange 7*b* at the lower end of the support 7.

The second portion 8 includes a raised portion 8*a* having a plate shape disposed along the raised portion 7*a* of the support 7, a flange 8*b* bent horizontally from the lower end of the raised portion 8*a* in the opposite direction to the flange 7*b* of the first support 7, and a flange 8*c* bent horizontally from the upper end of the raised portion 8 in the opposite direction to the flange 8*b* and flange 7*c* of the first support 7.

The second clamping portion 6 having the locking recess 5 is supported by the flange 8*c* at the upper end of the second support 8.

As shown in FIG. 2, there is provided a sliding portion 10 engaging freely and slidably the raised portion 7*a* of the first support 7 on the raised portion 8 of the second support 8. More particularly, a sliding groove 9 is formed on the raised portion 7*a* of the first support 7 extending in the sliding direction (seen vertically in FIG. 2) and the sliding portion 10 of the second support 8 engages freely and slidably the sliding groove 9.

In addition, an operation portion 11 (including a biasing member) is formed on the opposite side of the first clamping portion 3 and the second clamping portion 6 across the raised portion 7*a* and 8*a*.

The operation portion 11 includes a first lever 12 supported by the flange 7*c* of the support 7 and a second lever 12 supported by the flange 8*b* of the second support 8. Between the first lever 12 and the second lever 13, there is provided a spring member 14 retractable along the sliding direction, each end of which is locked to the fist lever 12 and the second lever 13. The spring member biases in the extension direction so as to separate the first lever and the second lever from each other. Accordingly, compression of the spring member 14 by pushing the outer sides of the first lever 12 and the second lever 13 with fingers, for instance, widens the distance between the first clamping portion 3 and the second clamping portion 6.

Conversely, when the spring member 14 extends by releasing the fingers from the first lever 12 and the second lever 13, the first clamping portion 3 and the second clamping portion 6 move to approach each other.

Additionally, on the side of the raised portion 7*a* of the clamping portion 7, a holder 15 (not shown in figures) having a slot (not shown in figures) as the holding member 2B is provided to hold a microphone 30.

The microphone 30 to be held includes a microphone main body 30*a*, a cable 30*b* and a flexible arm 31. The microphone holder 1 holds the microphone 30 by engaging a lower end of the flexible arm 31 with the slot (not shown) formed on the holder 15.

To mount the microphone 30 to a tom-tom 20 using the microphone holder 1 configured in the present manner, firstly, compress the spring member 14 by pushing the outer sides of the first lever 12 and the second lever 13 with fingers to widen the distance between the first clamping portion 3 and the second clamping portion 6. Secondly, engage the locking notch 4 of the first clamping portion 3 with the body of the tension bolt disposed at a lower part of the supporting member 23 of the rim 22. In this situation, the locking notch 4 encloses the body of the tension bolt 25. Successively, move the locking recess 5 of the second clamping portion upward to the head of the tension bolt 25, then release the fingers to let the spring member 14 extend so as to move the first clamping portion 3 to approach to the second clamping portion 6.

By this procedure, as shown in FIG. 5, the bolt head 25*a* of the tension bolt 25 is inserted to the locking recess 5 and the support 23 of the rim 22 is contact with the upper surface (the abutting surface) of the first clamping portion 3, with the locking notch 4 of the first clamping portion 3 enclosing the body of the tension bolt 25 and resultantly the first clamping portion 3 and the second clamping portion 6 clamp the rim 22 and the bolt head 25*a*. Thus the microphone holder 1 is securely fixed to the tension bolt 25.

After the microphone holder 1 is fixed to the tension bolt 25, the flexible arm 31 is inserted into the holder 15 so as to hold the microphone 30 with the microphone holder 1.

According to the present embodiment, the microphone holder 1 is fixed with the first clamping portion 3 and the second clamping portion 6 to the tension bolts 25 equipped for adjusting the tension of the drum head 21.

Consequently, the weight of the microphone is not applied on the rim so that tuning of the drumhead and collecting sound of the drum are successfully performed without being adversely affected.

In this embodiment the microphone holder 1 engages with the tension bolts 25 and the supporting member 23 and thus the microphone holder 1 is attached to the tom-tom. After having attached, however, there might be a possibility of rotation of the microphone holder 1 around the axis of the tension bolts 25.

Figure 6:
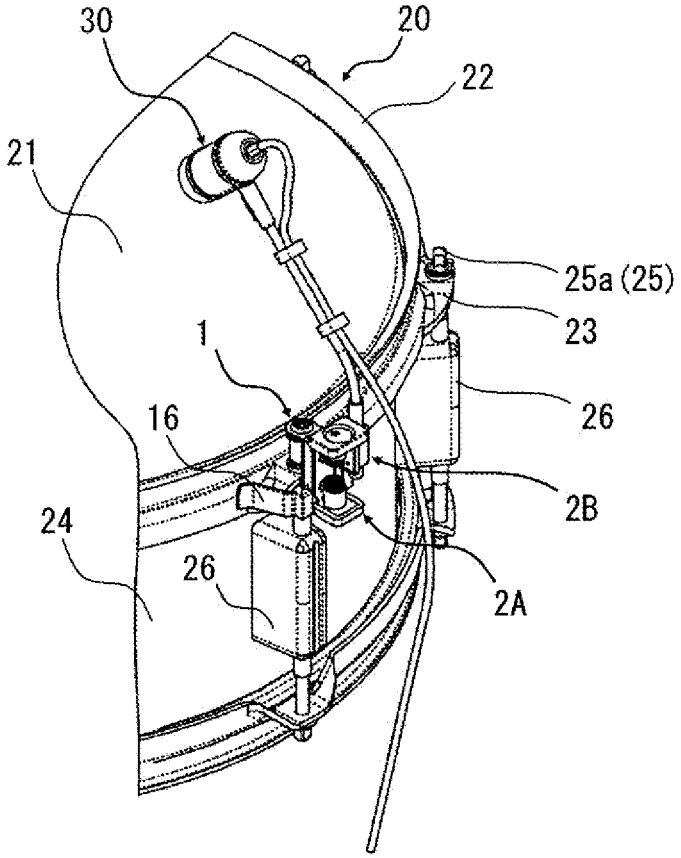
FIG. 6 is a perspective view of a modified example of the microphone holder.
Figure 7:
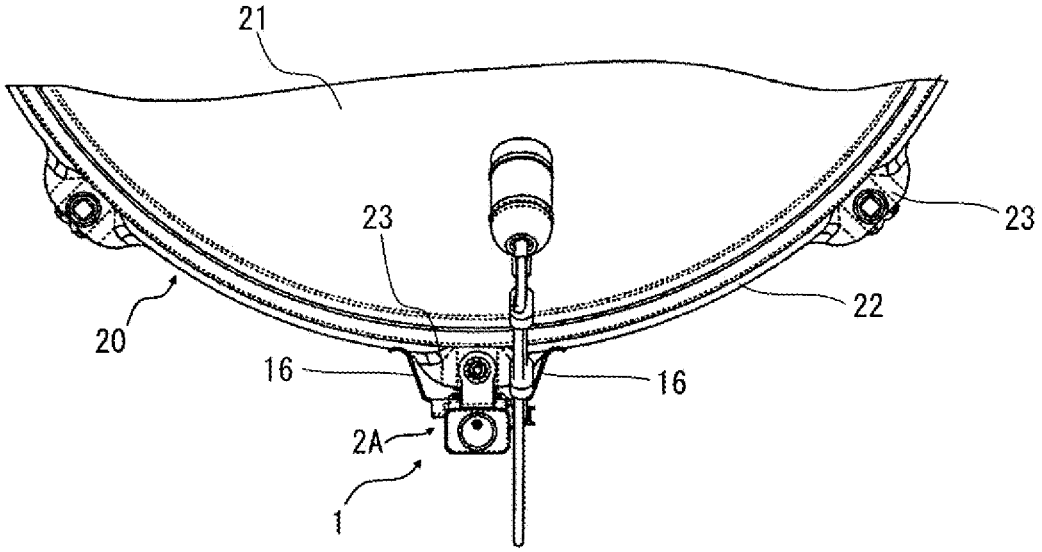
FIG. 7 is a plan view of the microphone holder shown in FIG. 6.
Figure 8:
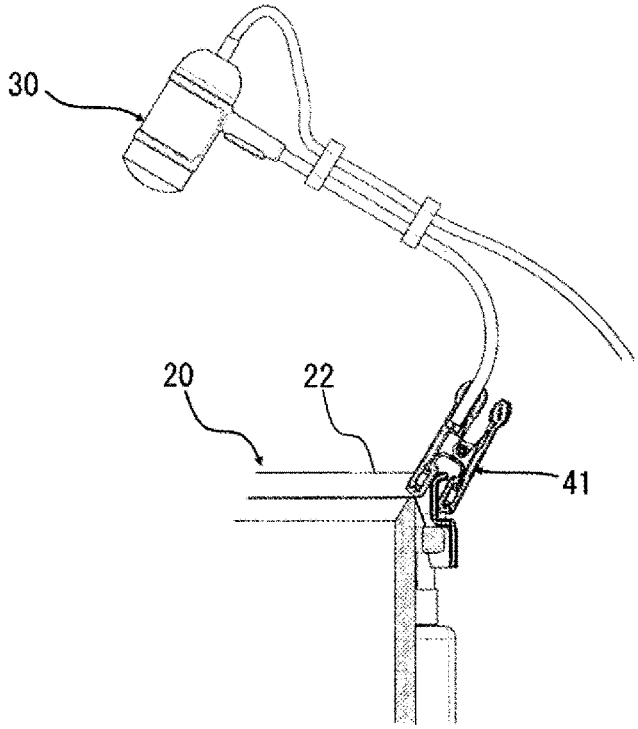
Fig. 8 Prior Art
FIG. 8 is a perspective view of a conventional microphone holder.
Figure 9:
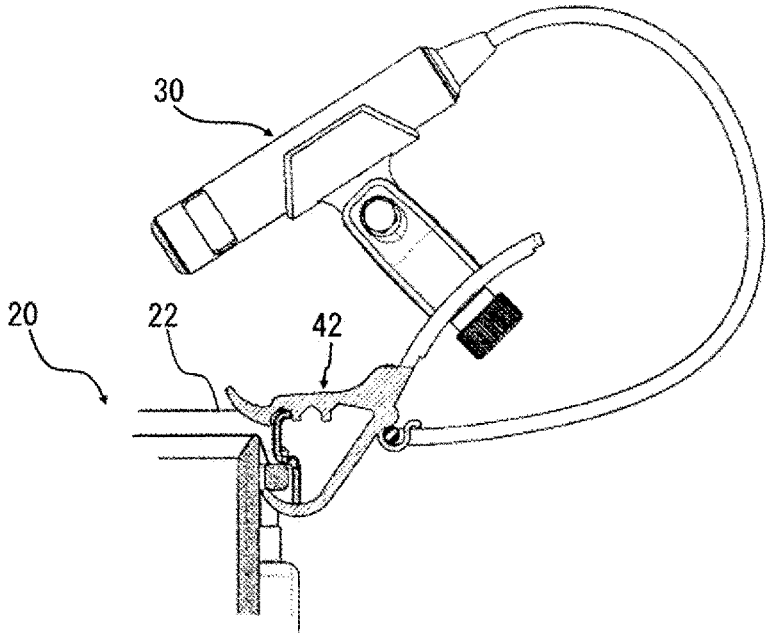
Fig. 9 Prior Art
FIG. 9 is a perspective view of a conventional microphone holder.

To prevent the microphone holder 1 from rotating around the axis of the tension bolts 25, plate-like support legs 16, as shown in FIGS. 6 and 7, are desirably provided extending from both right and left sides of the microphone holder 1 toward the direction of the rim 22 and contacting with the rim 22 so that the microphone holder 1 is fixed in a more stable condition. The legs 16 have the elasticity and spread from the microphone holder 1 toward the direction of the rim 22.

In the above embodiment, an example of setting the microphone holder 1 to the tom-tom 20 is shown but the microphone holder is also preferably used for a snare drum. Further, the microphone holder is preferably used for other type of drums having rims and tension bolts.

What is claimed is:

1. A microphone holder comprising:

a holding member holding a microphone; and a mounting member coupled to the holding member and adapted to be fixed to a tension bolt for fixing a rim of a drum, the mounting member comprising: a first clamping portion having a first locking portion for locking to a lower surface of the rim; a second clamping portion disposed above the first clamping portion and having a second locking portion for locking to a head of the tension bolt; and a biasing member biasing in a direction allowing the first clamping portion and the second clamping portion to approach, wherein the mounting member is attached to the tension bolt by clamping the rim and the head of the tension bolt between the first clamping portion and the second clamping portion with a biasing force of the biasing member, in a state that the first locking portion of the first clamping portion is locked to the lower surface of the rim and the second locking portion of the second clamping portion is locked to the head of the tension bolt.

2. The microphone holder according to claim 1, wherein the first locking portion of the first clamping portion includes an abutting surface having a non-slip surface, and a locking notch cut from one of the lateral sides, wherein the abutting surface is in contact with the lower surface of the rim in a state where the locking notch retains a body of the tension bolt.

3. The microphone holder according to claim 1, wherein the second locking portion of the second clamping portion includes a locking recess that is recessed upwardly from an opening provided at a lower end of the second clamping portion, and the head of the tension bolt is configured to be inserted into the locking recess.

4. The microphone holder according to claim 1, wherein the biasing member comprises:

a first support supporting the first clamping portion on one end and a first lever on the other end;

a second support supporting the second clamping portion disposed above the first clamping portion on one end and a second lever disposed below the first lever on the other end; and a spring member provided between the first lever and the second lever and configured to bias in a direction separating the first lever and the second lever from each other, and wherein the first clamping portion and the second clamping portion are moved in a separating direction from each other by compressing the spring member and allowing the first lever and the second lever to come close to each other, and moved in a direction coming close to each other by stretching the spring member and allowing the first lever and the second lever to separate from each other.

5. The microphone holder according to claim 2, wherein the biasing member comprises:

a first support supporting the first clamping portion on one end and a first lever on the other end;

a second support supporting the second clamping portion disposed above the first clamping portion on one end and a second lever disposed below the first lever on the other end; and a spring member provided between the first lever and the second lever and configured to bias in a direction separating the first lever and the second lever from each other, and wherein the first clamping portion and the second clamping portion are moved in a separating direction from each other by compressing the spring member and allowing the first lever and the second lever to come close to each other, and moved in a direction coming close to each other by stretching the spring member and allowing the first lever and the second lever to separate from each other.

6. The microphone holder according to claim 3, wherein the biasing member comprises:

a first support supporting the first clamping portion on one end and a first lever on the other end;

a second support supporting the second clamping portion disposed above the first clamping portion on one end and a second lever disposed below the first lever on the other end; and a spring member provided between the first lever and the second lever and configured to bias in a direction separating the first lever and the second lever from each other, and wherein the first clamping portion and the second clamping portion are moved in a separating direction from each other by compressing the spring member and allowing the first lever and the second lever to come close to each other, and moved in a direction coming close to each other by stretching the spring member and allowing the first lever and the second lever to separate from each other.

7. The microphone holder according to claim 4, wherein the first support and second support are slidably engaged with each other.

8. The microphone holder according to claim 5, wherein the first support and second support are slidably engaged with each other.

9. The microphone holder according to claim 6, wherein the first support and second support are slidably engaged with each other.

10. The microphone holder according to claim 1, further comprises a pair of support legs extending toward the rim from both left and the right sides of the mounting member, wherein distal ends of the pair of support legs are in contact with the rim.

* * * * *